United States Patent [19]

Granholm et al.

[11] 3,961,486

[45] June 8, 1976

[54] PIPE FOR STICKING DOWN DRAINS INTO THE GROUND

[75] Inventors: Sven Granholm; Signar Lundmark, both of Skelleftea, Sweden

[73] Assignee: Linden-Alimak AB, Skelleftea, Sweden

[22] Filed: Oct. 22, 1974

[21] Appl. No.: 516,923

[52] U.S. Cl. ..... 61/11; 61/13

[51] Int. Cl.[2] ..... E02B 11/00

[58] Field of Search ..... 61/11, 13, 63, 53.66, 61/58, 60–62, 34; 166/52; 138/119, DIG. 8, DIG. 11; 29/155 R; 285/175, 424; 256/DIG. 5

[56] References Cited

UNITED STATES PATENTS

| | | | |
|---|---|---|---|
| 785,274 | 3/1905 | Schlevssner | 61/60 |
| 2,128,428 | 8/1938 | Murray | 61/60 |

FOREIGN PATENTS OR APPLICATIONS

| | | | |
|---|---|---|---|
| 8,654 | 4/1888 | United Kingdom | 256/5 |
| 622,222 | 4/1949 | United Kingdom | 61/60 |

*Primary Examiner*—Dennis L. Taylor
*Attorney, Agent, or Firm*—Elliott I. Pollock

[57] ABSTRACT

A tube for sticking stripformed drains into the ground has a predetermined fixed profile of rhombic cross section made by pressing two opposite corners of a square tube towards each other.

4 Claims, 1 Drawing Figure

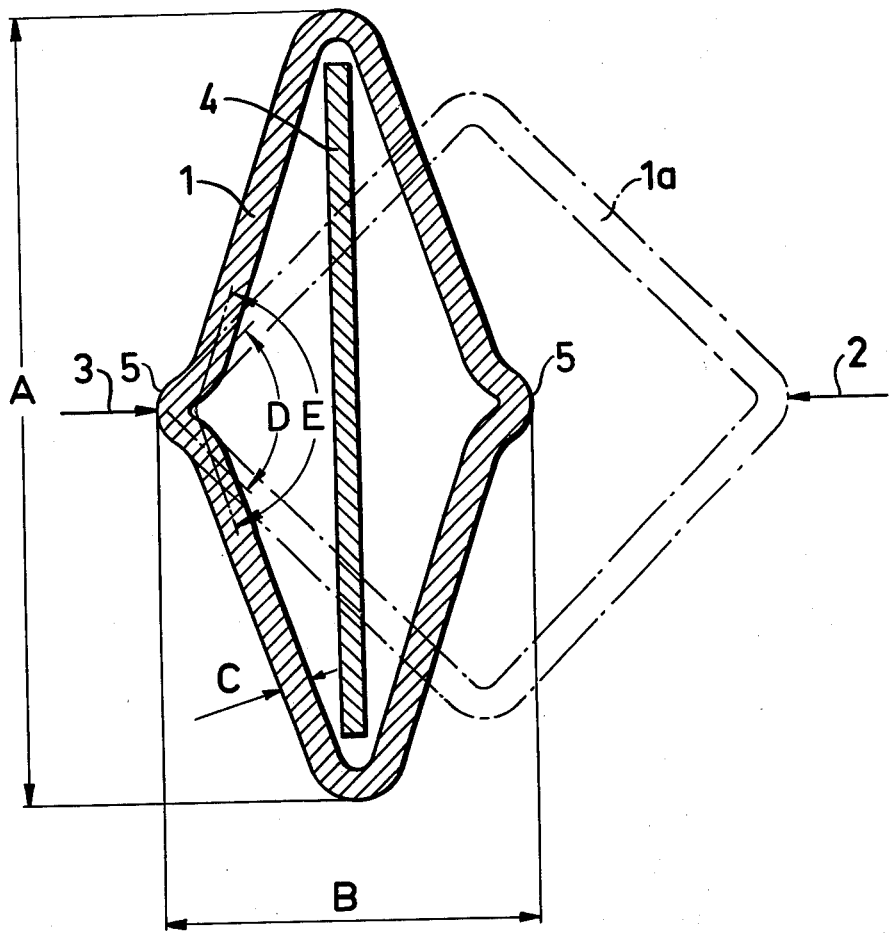
4
1
1a
3
5
5
2
A
D
E
C
B

PIPE FOR STICKING DOWN DRAINS INTO THE GROUND

Drains are used for vertical draining, slope stabilization and the like in order to improve the stability in e.g. clayey ground, and can consist of a combination of paper and plastic material in strip form as in the Swedish Pat. No. 343 902.

To stick the drains into the ground a sticking pipe is generally used, which is forced into the ground mechanically and within which the drain is protected when being stuck down. After the sticking down operation is completed, the pipe is drawn up and the drain remains in the ground.

A sticking pipe with a circular cross section is e.g. known from the Swedish Pat. No. 102.311. This circular profile shows a bending resistance satisfactory for proper insertion of the pipe into the ground, which is an important pre-requisite to assure that the sticking pipe — the length of which is often more than 10 m — can be stuck down into the ground for the whole of its length without being deformed. However, it has been found that sticking pipes with a circular cross section often cause unfavourable disturbances in the surrounding ground. When the sticking pipe is being forced down into the ground, the ground surrounding the pipe is disturbed in the respect that the shearing strength of the ground is substantially reduced due to the rheological properties of the clays and within a range, the size and appearance of which are dependent on the cross sectional area and shape of the sticking pipe. This reduction of the ground strength may cause great problems in case of heavily loaded grounds. Moreover pipes with a circular cross section require a relatively great sticking down force due to their relatively great cross sectional area, which in turn means that heavier and more expensive forcing down machinery must be used.

In order to reduce the disturbances in surrounding ground, and also to reduce the required sticking down force, attempts have been made to use sticking pipes having a relatively thin rectangular cross section, whose internal channel is not much wider than that of the drain so that the drain may run freely therein. It has been found that this sticking pipe provides a substantially less range of disturbance and also requires a lower sticking down force. The bending resistance has however turned out to be unsatisfactory.

It is the object of the present invention to provide a sticking pipe, which substantially shows all the positive properties of the known pipes in respect of disturbance of surrounding ground, bending resistance and sticking down force.

One illustrative example of the sticking pipe according to the invention is shown on the enclosed drawing.

The pipe designated by 1 has a substantially rhombic cross section. The greatest distance A is located between two opposite corners and is in this illustrative example about 130 mm, whereas the smallest distance B is located between the other two opposite corners and is 60 mm. The pipe is preferably made from steel and has a length of 10 m and a wall thickness C of 5 mm in order to obtain a satisfactory firmness.

The pipe is preferably shaped from a square standard profile 1a with rounded corners and a constant wall thickness, which profile is pressed by forces 2 and 3 diagonally in an edge press until the desired ratio, e.g., 1/2, between the symmetry axes has been obtained, a final profile being achieved wherein the sides meeting at the opposite corners 5 show the smallest reciprocal distance and have portions which form at the very corner 5 a more acute angle D (about 90°) with each other than the angle E formed by the main parts of the sides adjoining each corner 5. In addition to the fact that this profile is simple to produce, additional bending resistance is also obtained by the extra projecting portion which will be formed at the corners 5 in this way.

The FIGURE also shows how a strip formed drain 4 is located in the pipe 1.

We claim:

1. An elongated pipe adapted to be driven into the ground in the direction of its elongation for use in sticking drains down into the ground, said pipe having a predetermined, fixed cross-sectional profile of substantially parallelogram shape, two opposite corners of said parallelogram being substantially closer to one another than the other two opposite corners thereof, all sides of said parallelogram being integral with one another and the dimensions of said parallelogram being substantially constant throughout the length of said pipe, the parallelogram shape of said pipe causing said pipe to exhibit resistance to bending sufficient to permit said pipe to be driven into the ground and causing comparatively small disturbance of the ground as said pipe is driven into the ground, said pipe being used to protect a drain located therein, the spacing between the more widely spaced corners of said parallelogram being at least as great as the width of such a drain.

2. The pipe of claim 1 wherein said profile is substantially rhombic.

3. The pipe of claim 1 wherein the distance between said closer two opposite corners is substantially one half the distance between said other two opposite corners.

4. The pipe of claim 1 wherein the two sides of said parallelogram which adjoin one another at each of said closer two opposite corners include comparatively short portions at the very corner which are at a more acute angle to one another than the angle formed between the main portions of said two sides.

* * * * *